US006627808B1

(12) United States Patent
Coats et al.

(10) Patent No.: US 6,627,808 B1
(45) Date of Patent: Sep. 30, 2003

(54) ACOUSTIC MODELING APPARATUS AND METHOD

(75) Inventors: Elon Ray Coats, Meridian, MS (US); Earnest Lloyd Trammell, Meridian, MS (US); Michael V. Powers, Meridian, MS (US)

(73) Assignee: Peavey Electronics Corporation, Meridian, MS (US)

( * ) Notice: Subject to any disclaimer, the term of this patent is extended or adjusted under 35 U.S.C. 154(b) by 0 days.

(21) Appl. No.: 10/233,847

(22) Filed: Sep. 3, 2002

(51) Int. Cl.[7] ..... G10H 3/14

(52) U.S. Cl. ..... 84/723; 84/725; 84/726; 84/730; 84/731

(58) Field of Search ..... 84/723, 725–726, 84/730–731, 736–737, DIG. 9, DIG. 24

(56) References Cited

U.S. PATENT DOCUMENTS

| | | | | |
|---|---|---|---|---|
| 4,151,776 A | | 5/1979 | Stich | 84/1.16 |
| 4,911,057 A | | 3/1990 | Fishman | 84/731 |
| 5,723,804 A | * | 3/1998 | Replogle | 84/726 |
| 6,121,537 A | | 9/2000 | Pawar et al. | 84/728 |
| 6,191,350 B1 | * | 2/2001 | Okulov et al. | 84/646 |
| 6,242,682 B1 | * | 6/2001 | Marinic et al. | 84/626 |
| 6,288,320 B1 | * | 9/2001 | Murakami et al. | 84/622 |
| 6,372,976 B2 | | 4/2002 | Damm | 84/723 |

* cited by examiner

*Primary Examiner*—Marlon T. Fletcher
(74) *Attorney, Agent, or Firm*—Thomas, Kayden, Horstemeyer & Risley, L.L.P.

(57) ABSTRACT

An apparatus and method for modeling an acoustic sound in an electric stringed musical instrument is provided. A preferred embodiment, among others, includes a bridge sensor configured to sensing string vibrations at the bridge of the instrument so that a bridge signal is generated in accordance with the vibrating strings. A body sensor, which may be positioned at different points on or within the body of the instrument, senses the resonance of the string vibrations. The body sensor generates a body resonance signal in accordance with the sensed resonance. An amplification circuit amplifies the body resonance signal when the amplitude of bridge signal exceeds a first predetermined level. In addition, a second amplification circuit amplifies the bridge signal. A summing circuit adds the amplified body resonance signal with the amplified bridge signal to produce an output signal that, when replicated in sound, models the sound of an acoustic instrument.

32 Claims, 4 Drawing Sheets

ACOUSTIC MODELING APPARATUS AND METHOD

FIELD OF THE INVENTION

The present invention generally relates to electric stringed musical instruments and, more specifically to an apparatus and method for replicating the sound of an acoustic stringed musical instrument with an electric stringed musical instrument.

BACKGROUND OF THE INVENTION

It is well known that electric and acoustic guitars have different sounds. One of the more notable differences between the two types of guitars is the natural volume generated by each instrument. Guitar makers and players have searched for ways to increase the volume of the acoustic guitar. The advent of electronic amplification was one of the first and most successful innovations for building a louder guitar.

An acoustic guitar produces sounds in accordance with the striking of strings that causes the strings to vibrate. The energy from the vibrating strings is transferred to the soundboard of the guitar through the guitar's bridge. An acoustic guitar's hollow body amplifies the sound of the vibrating strings. However, the maximum volume achievable in an acoustic guitar may be insufficient in some instances, as the sound is unamplified. The aesthetic sound and timbre generated by the acoustic guitar, however, is often preferred because of its distinctiveness.

An electric guitar typically has a solid or mostly solid body because, unlike an acoustic guitar, the body of an electric guitar is typically not used for amplifying the sound produced by the vibrating strings. Instead, an electric guitar usually employs an electrical transducer, referred to as a pickup system, to detect the movement of the strings. Various types of pickup systems may be used in electric guitars to sense the vibration of the strings at various points and according to various methods. Such pickup methods include piezoelectric sensors as well as single and double coil transducer sensors. These pickup systems sense the string vibrations and convert them into electrical signals that are communicated to an amplifier for increasing the volume of the sound of the vibrating strings.

The electrical pickup systems in electric guitars generally do not model the sound of acoustic guitars, but rather produce a greatly modified sound corresponding to the string's pure tones. However, the tone of the strings of an electric guitar generally does not model the tone of the strings of an acoustic guitar, which in large part, accounts for the different sound in each instrument. For example, if the strings of an acoustic guitar are struck with greater intensity, the sound emitted from the acoustic guitar is greater. While the same phenomenon occurs to some degree with an electric guitar, it does not approach the scale of amplification that is realized in an acoustic guitar, even when "plugged in." Stated another way, unlike an acoustic guitar, striking the strings of an electric guitar with a greater intensity does not result in a proportionally amplified sound.

With the advent of electric guitars, many attempts have been made to make the sound of the electric guitar conform to, or model, the sound of an acoustic instrument, however, with little success. One prior attempt has involved using a single piezoelectric bridge pickup (with and without frequency shaping) to generate an acoustic like tone from an electric six-string or bass guitar. The sound with a single piezoelectric bridge pickup is generally superior to the sound of an electrical pickup, such as a single or dual coil transducer pickup; however, it does not emulate the acoustic sound properly. Moreover, a problem exists in modeling the proper amplification of sound resulting from the harder playing dynamics of the electric guitar. As a result, a heretofore-unaddressed need exists in the industry to address the aforementioned deficiencies.

SUMMARY OF THE INVENTION

One embodiment, among others, of the apparatus and method for modeling an acoustic sound in an electric stringed musical instrument, such as an electric guitar, includes a bridge sensor configured to sense string vibrations at the bridge of the instrument so that a bridge signal is generated in accordance with the vibrating strings. One or more body sensors, which may be positioned at different points on or within the body of the instrument, sense the resonance due to the string vibrations. The body sensors generate a body resonance signal in accordance with the sensed resonance. An amplification circuit amplifies the body resonance signal when the amplitude of bridge signal exceeds a first predetermined level. In addition, a second amplification circuit amplifies the bridge signal. A summing circuit adds the amplified body resonance signal with the amplified bridge signal to produce an output signal that upon replication as sound models the sound of an acoustic instrument.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
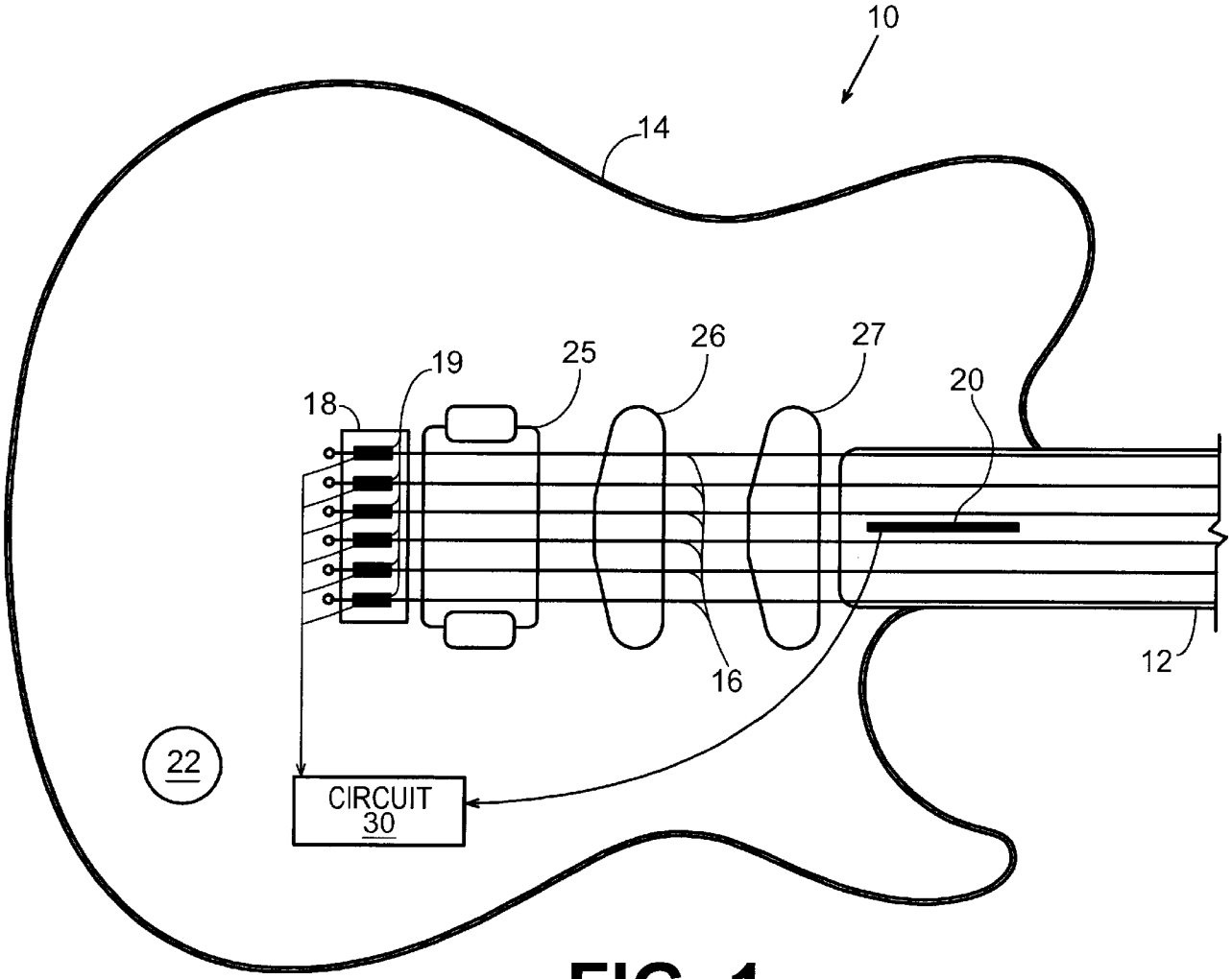
FIG. 1 is a diagram of an electric stringed musical instrument illustrating a portion of the neck or fingerboard secured to a main body, which includes a multiple pickup system, including bridge and body sensors.

Referring now to the drawings wherein the showings are for the purposes of illustrating a preferred embodiment of the invention only and not for purposes of limiting same, FIG. 1 depicts a stringed musical instrument 10. The stringed musical instrument may be implemented as any electric stringed musical instrument including, without limitation, an electric guitar, an electric bass guitar, a violin, as well as other stringed musical instruments as known in the art. For purposes of this description, the string musical instrument will be referenced as guitar 10.

FIG. 1 shows guitar 10 with a multiple pickup system illustrating a portion of the neck or fingerboard 12 secured to a main body 14. The guitar 10 includes guitar strings 16 that are secured on one end to a bridge 18 and, on the other end, to a tuning head (not shown) in a manner well known in the art. The traditional ¼ inch open circuit jack (not shown) is provided to interface the electric pickup within the guitar 10 to associated electrical equipment such as amplifiers and the like in a well known manner.

As typically included as part of an electric guitar, coil pickups 25, 26, and 27 are shown arrayed beneath the strings 16 and secured on the face of body 14 in a conventional manner known in the art. These pickup units 25, 26, and 27 may be configured as a variety of pickups well known in the art. As a non-limiting example, pickup units 25, 26, and 27 may be single coil or stacked dual coil pickup units. Likewise, guitar 10 may include a flat dual coil pickup, also known as a humbucking pickup, for generating an entirely different tonality from pickups 26 and 27. As stated above, pickups 25–27 are well known in electric guitars for producing the electrified sound of the electric guitar.

A plurality of bridge sensors 19 are positioned on bridge 18 in direct contact with the strings 16 of the electric guitar 10. In this non-limiting example, each bridge sensor 19 is configured as a piezoelectric transducer. While piezoelectric transducers are well known in the art, it should also be obvious to one of ordinary skill in the art that other types of pickups may also be implemented instead of a piezoelectric transducer.

In this non-limiting example where the bridge sensors 19 are comprised of piezoelectric transducers, a quartz element in the piezoelectric transducer generates a frequency in response to the vibrating string. In this manner, an electrical signal is generated as the user strikes the strings of guitar 10. Each string 16 is coupled to a separate piezoelectric transducer (in this non-limiting example) so that the vibration of each string is individually detected by a piezoelectric transducer at the bridge 18.

FIG. 1 also shows a body sensor 20, which in this non-limiting example, is shown positioned near the neck 12 of guitar 10. It should also be noted that body sensor 20 may be mounted on the surface of body 14 or within an internal cavity of the body 14. More specifically, body 14 may include one or more internal cavities to house body sensor 20 for the purpose of detecting the resonance due to the vibrating strings at a point within the body 14.

Also positioned on the face of body 14 is selector 22. Selector 22 may be configured to activate or deactivate bridge sensors 19 and body sensor 20. An additional selector mechanism (not shown), similar to selector 22, may be configured to activate and/or deactivate various combinations of pickups 25, 26, and 27, or equalization circuits, as described in more detail below.

The body sensor 20 may be implemented using any of the known pickup techniques. One of ordinary skill in the art would understand that body sensor 20 may be configured as a mechanical sensor or other pickup mechanism to detect vibrations that reverberate through body 14. As a non-limiting example, the body sensor 20 may be a microphone pickup system to detect the resonance of the strings reverberating through the body of the guitar 10 or internal cavity within body 14, as described above. As another non-limiting example, body sensor 20 may also be implemented as a plurality of individual sensors positioned together or at separate points on or within body 14. In the preferred embodiment, body sensor 20 comprises one or more piezoelectric transducers, as known in the art.

It should also be understood that body sensor 20 may be configured or located at any point on or within the body 14 and not necessarily as shown in FIG. 1. In fact, to achieve different sounds and different tonal qualities, the body sensor 20 may be positioned at various points on or within the body 14 for detecting the vibrations of the strings resonating through the body at different points and intensities. However, in the non-limiting example shown in FIG. 1, body sensor 20 is positioned at the junction of the neck 12 and body 14.

To accurately produce the sound textures of an acoustic instrument, the bridge sensors 19 and body sensor 20 operate in conjunction to model an acoustic sound. The electrical signals created by each of these piezoelectric pickups are combined and equalized to replicate the sound (timbre and dynamics) of an acoustic instrument. To replicate the acoustic sound, an electric signal is communicated from both the bridge sensors 19 and the body sensor 20 to circuit 30.

Figure 2:
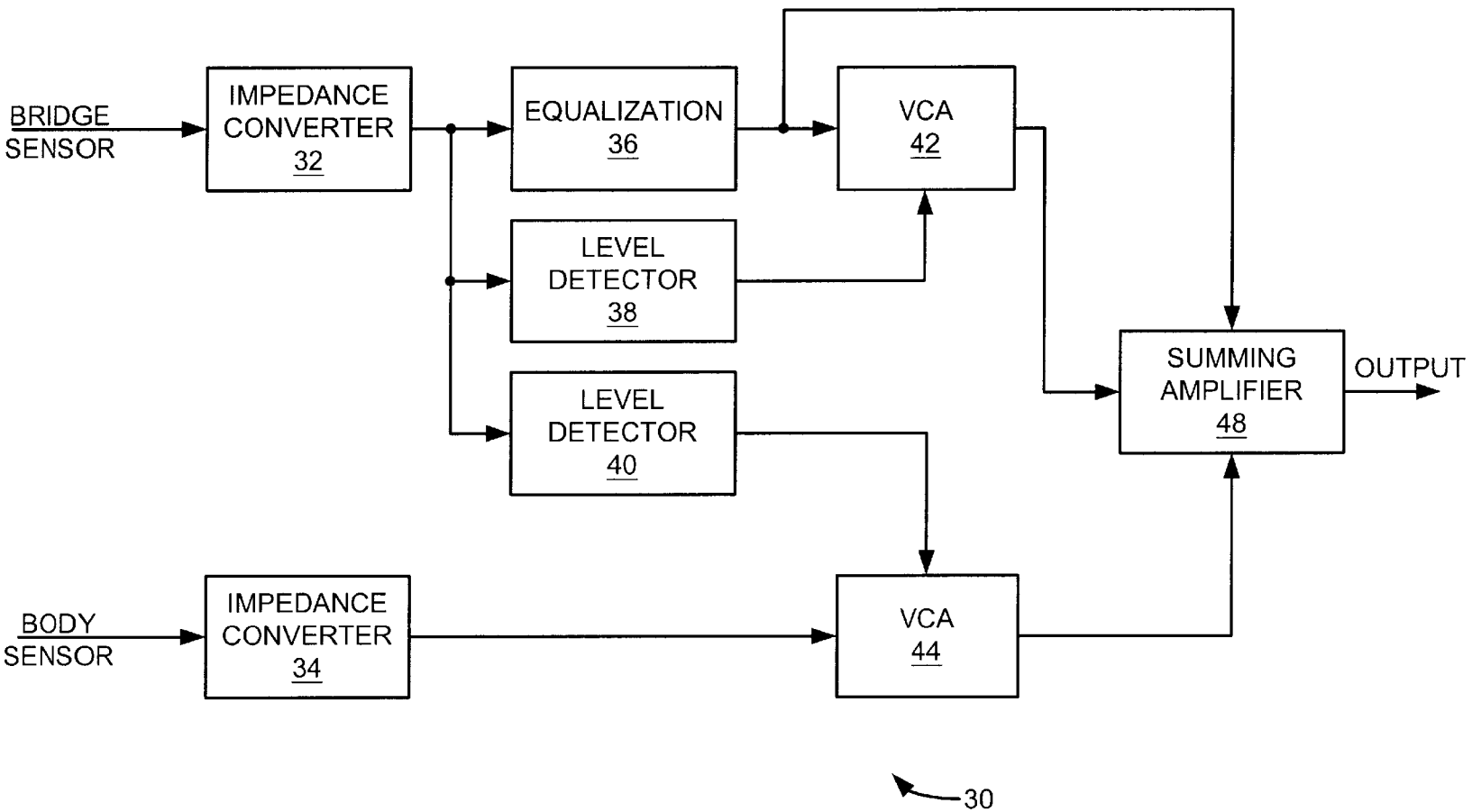
FIG. 2 is a block diagram of the acoustic modeling circuit of FIG. 1.

FIG. 2 is a block diagram of the circuit 30 of FIG. 1. Circuit 30 receives input from bridge sensors 19 and body sensor 20 for replicating the sound of an acoustic instrument. The signal from each of the bridge sensors 19 (FIG. 1) is input to impedance converter 32. The impedance converter 32 operates to buffer the input to circuit 30 from the bridge sensors 19, which, according to this non-limiting example, is a piezoelectric pickup having high impedance. The impedance converter 32 receives the high impedance bridge transducer signal and outputs a signal having a low impedance value matched to the remainder of circuit 30. Impedance converter 32 may also be configured with a predetermined amount of gain to boost, or amplify, the signal received from the bridge transducer 19. However, in this non-limiting example, impedance converter 32 is configured as a unity gain device because the signal received from the bridge sensors 19 generally has sufficient amplitude, since the strings directly contact bridge sensors 19.

Impedance converter 34 receives the output signal from body sensor 20. Similar to impedance converter 32, impedance converter 34 operates as a buffer to accept a high input impedance signal and output a lower impedance signal for the remainder of circuit 30. Stated another way, the impedance converter 34 operates to match the impedance between the body sensor 20 and the remaining portion of the circuit 30 in FIG. 2.

The signal output from this impedance converter 32 is provided to an equalization circuit 36. The equalization circuit 36 may be configured in any combination of equalization circuits, as known to one of ordinary skill in the art. In this non-limiting example, the equalization circuit 36 may be configured as a notch filter to reduce the middle portion of the frequency range detected by the bridge sensors 19. As known to one of ordinary skill in the art, piezoelectric transducer sensors typically generate high energy levels in the middle frequency range; thus, the equalization circuit 36 may be configured to remove or reduce the energy in the mid-level frequencies to produce a preferred sound. One of ordinary skill in the art would also know that rather than filtering out a portion of the middle ranges of the frequency spectrum, the equalization circuit 36 may be configured to boost the low and high ranges of the frequency spectrum to a level comparable to the level of the mid-level frequency range. Thus, it should be apparent to one of ordinary skill in the art that equalization circuit 36 may be configured in a variety of configurations depending upon whether the desired effect is to notch (reduce) or boost a select frequency range to achieve the desired dynamic equalization effect and sound. Regardless of the configuration of equalization circuit 36, the output from equalization circuit 36 is a signal in which the low, middle, and high frequencies are adjusted as desired.

Acoustic modeling circuit 30 also depicts a pair of level detectors 38 and 40. Level detectors 38 and 40 may be configured identically to each other or they may be configured to produce different outputs, which affects the sound output by guitar 10. Level detectors 38 and 40 are configured to detect the amplitude of the signal received from bridge sensors 19. When the strings 16 of guitar 10 are caused to vibrate (played), the result of the signal produced by bridge sensors 19 causes the level detectors 38 and 40 to produce a corresponding control signal. The control signal output by level detector 38 is communicated to a voltage controlled amplifier (VCA) circuit 42 (hereinafter referred to as "bridge VCA circuit 42"), and the signal output from level detector 40 is communicated to VCA circuit 44 (hereinafter referred to as "body VCA circuit 44"). The output control signals are proportionally related to the vibrations of strings 16. Thus, the greater the intensity of string vibrations, the higher the control signal output by level detectors 38 and 40 to bridge VCA circuit 42 and body VCA circuit 44, respectively. The control signal output by level detectors 38 and 40 track the amplitude of the input signal, which is based upon the vibrations sensed at the bridge. Thus, when a user plays guitar 10 with greater intensity, the control signal output from level detectors 38 and 40 increases proportionally.

It should be noted that control signals output by level detectors 38 and 40 may not be identical. The increase in amplitude of the input signal to each of level detectors 38 and 40 may result in output signals at different levels.

The bridge VCA circuit 42 operates to amplify the signal received from equalization circuit 36. Thus, the control signal received by bridge VCA circuit 42 from level detector 38, which corresponds to the intensity of the string vibrations at the bridge, determines the level of gain applied to the output of equalization circuit 36. Accordingly, when the user plays the guitar 10 with greater intensity, the resulting output from the bridge VCA circuit 42 is a signal of higher amplitude. Likewise, when the user plays the strings 16 lightly or delicately, the level detector 38 operates to produce a lower level control signal. In this instance, bridge VCA circuit 42 amplifies the signal from bridge sensors to a lesser degree such that the resulting sound is replicated at a lower volume. In this manner, the bridge VCA circuit 42 enables the user to adjust the volume of the sound output by guitar 10 in accordance with the vibration intensity of strings 16, which is similar to the manner of playing an acoustic instrument. As stated above, this effect is in contrast to an electric guitar that lacks such a voltage controlled amplifier, which results in little to no volume adjustment with respect to the level of intensity of play by the user.

Bridge VCA 42 may also include an expansion circuit, which is discussed in more detail below in regard to FIG. 3. The expansion circuit operates to increase the dynamic range of the signal received from the bridge transducer 19. By expanding the dynamic range of signal supplied by the bridge sensors 19, the resulting output signal, when reproduced as a sound, more closely replicates the sound produced by an acoustic instrument. In this manner, the expansion circuit contained in bridge VCA circuit 42 enables the guitar 10 to further model the timbre and dynamics of an acoustic guitar or instrument.

Returning to the signal path from body sensor 20, the signal that is output from the impedance converter 34 is communicated to body VCA circuit 44. The body VCA circuit 44 may be similar or even identical to the bridge VCA circuit 42, as described above. The body VCA circuit 44 receives a control signal from level detector 40, which shares an input with level detector 38 and equalization circuit 36 from the output from impedance converter 32. In this way, the signal corresponding to the bridge sensors 19, which senses the vibration of the strings 16 at the bridge 18, enables level detector 40 to control the amplitude of the signal corresponding to body sensor 20. The control signal emitted from level detector 40 controls the gain of body VCA circuit 44. As a result, the signal received from impedance converter 34 is amplified by body VCA circuit 44 according to level detector 40.

The level detector 40 may be configured so that it activates and/or deactivates the body VCA circuit 44 in accordance with the playing conditions sensed by the bridge sensors 19 at the bridge 18. In one non-limiting example, when the user strikes the strings 16 with greater intensity, the increased level of the bridge transducer signal may cause body VCA circuit 44 to activate and amplify the body transducer signal. The output from body VCA circuit 44, therefore, includes the amplified signal corresponding to body sensor 20, which is communicated to summing amplifier 48 for addition with the signal corresponding to bridge sensors 19. However, according to this non-limiting example, until the user strikes the strings at a predetermined intensity level, body VCA circuit 44 may not be engaged and may not amplify the body transducer signal to any degree. The result in this situation is that the body transducer signal is at or near a zero or nil level such that its summing effect recognized by summing amplifier 48 is negligible.

When the intensity level placed on the strings 16 increases, the resulting output includes the amplified and equalized signal sensed by the bridge sensors 19 as well as the level controlled signal from the body sensor 20. As a result, the volume is increased beyond the level than it would otherwise be. In this manner, the electric guitar 10 models the sound and dynamic range of an acoustic guitar.

The output of bridge VCA circuit 42 is communicated to summing amplifier 48. It should also be noted that the output from equalization circuit 36, which is input to bridge VCA circuit 42, is also communicated to summing amplifier 48. Finally, the output from body VCA circuit 44 is coupled as an input to summing amplifier 48. The summing amplifier 48 sums these inputs to produce an output of circuit 30.

Figure 3:
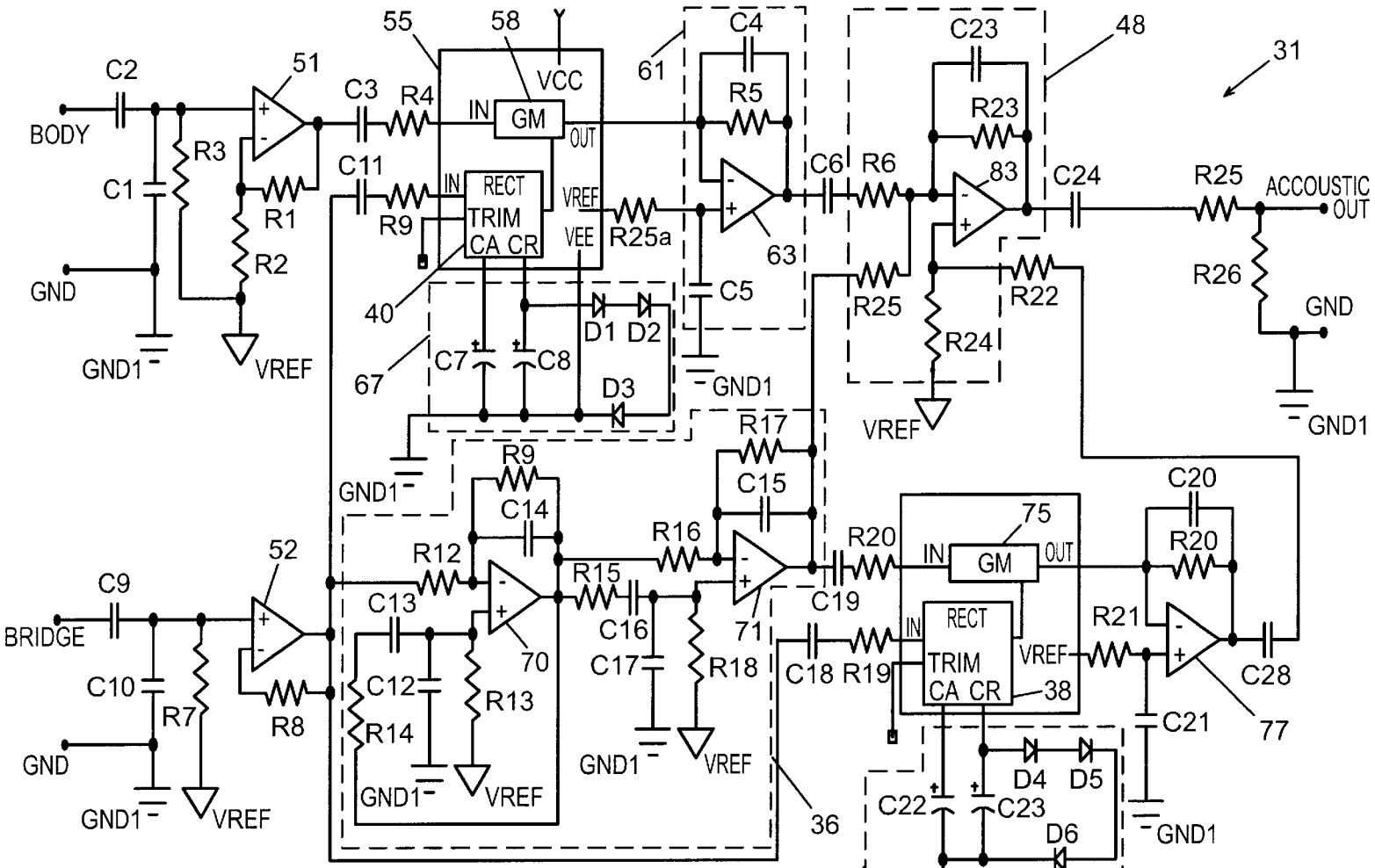
FIG. 3 is a schematic circuit diagram of the acoustic modeling circuit of FIG. 1.

FIG. 3 is schematic diagram 31 of the circuit block diagram 30 of FIG. 2. It should be noted that this is one non-limiting example of the embodiment described herein. One of ordinary skill in the art would know that other circuits may be implemented in conformance with this embodiment to model an acoustic instrument. As such, the schematic diagram 31 shown in FIG. 3 is not intended to limit this embodiment to a single schematic configuration.

The signal received from body sensor 20 is communicated to the amplifier 51. Capacitor C1 is positioned between the body sensor 20 output and ground to help provide a clean signal to amplifier 51. Capacitor C2 likewise operates to reduce any DC voltages in a signal received from the body sensor 20.

Amplifier 51 is coupled to resistors R1, R2, and R3, which collectively are configured to provide a low gain and match the impedance between the piezoelectric elements in body sensor 20 and remaining elements in circuit schematic 31.

Amplifier 51 is configured with a predetermined amount of gain because the signal received from body sensor 20 may be of lower magnitude than the signal received from bridge sensors 19. These signals exhibit different magnitudes because the bridge sensors 19 are in direct contact with the vibrating strings 16, while the body sensor 20 is located at some point on or within the body 14 of guitar 10 and not in direct contact with the strings 16. For this reason, the natural resonance that reverberates through the guitar body 14 is of lower intensity than the resonance of the vibrating strings 16. The signal output from amplifier 51 is passed through the capacitor C3 and resistor R4, which are coupled in series to circuit block 55.

Circuit block 55 includes gain cell 58 and level detector 40, as shown in FIG. 2. The gain cell 58 operates in conjunction with body resonance amplifier circuit 61 to form the body VCA circuit 44, as shown in FIG. 2. Gain cell 58 receives a control signal from level detector 40. The control signal sets the gain level of gain cell 58, which amplifies the signal communicated from amplifier 51, as discussed above and also shown herein. Level detector 40 receives an input signal from the bridge sensors 19 via amplifier 52. Thus, the level detector 40 operates in response to the bridge sensor signal for adjusting the gain of gain cell 58 that amplifies the body sensor signal.

Limiting circuit 67 is coupled to level detector 40. Capacitors C7 and C8 set the attack and release response times with diodes D1, D2, and D3 in the limiting circuit 67. Limiting circuit 67 limits the control signal output by level detector 40 to clamp or stop the level of gain from ascending higher than a predetermined value. In operation, limiting circuit 67 causes the level detector 40 to prevent the gain from continuing to amplify the body sensor signal, as the signal corresponding to the bridge sensors 19 intensifies beyond a predetermined level. Thus, even if the bridge sensor signal surpasses the level set by limiting circuit 67, the level of gain for gain cell 58 stops increasing, which, therefore, provides that the body sensor signal remains at a constant level during this period.

The effect of limiting circuit 67 to the listener or user playing the guitar 10 is that the body resonance volume corresponding to the intensity placed on string 16 does not further increase beyond a predetermined intensity level or predetermined amplitude level corresponding to the vibration of the strings detected at the bridge. Additionally, it should be obvious to one of ordinary skill in the art that limiting circuit 67 may be configured in various formats to achieve different limiting results with level detector 40.

The body resonance amplifier circuit 61 receives the output from gain cell 58 and converts it to a corresponding amplified body pickup signal. Amplifier 63, resistor R5, and capacitors C4 and C5 comprise body resonance amplifier circuit 61. The body resonance amplifier circuit 61 operates to adjust the level of the body signal so that it follows the amplitude envelope of the signal at the input of level detector 40, which corresponds to the sensed bridge sensor signal. The signal output from amplifier 63 is communicated through capacitor C6 and resistor R6 to summing amplifier circuit 48.

The string vibrations sensed at the bridge 18 are communicated to amplifier 52. Capacitor C9 operates in a similar fashion to capacitor C2, as described above, and capacitor C10 operates in a similar fashion to capacitor C1. Resistor R7 is coupled between a reference voltage (supply not shown) and the amplifier 52 input. Amplifier 52 is configured in this non-limiting example as a unity gain amplifier and is coupled to and includes resistor R8 on a feedback path. The output from amplifier 52 is routed to level detector 40, as described above, through capacitor C11 and resistor R9, which operate to reduce DC currents and limit the AC current input to the level detector 40.

The output from amplifier 52 is also coupled to equalization circuit 36. In this non-limiting example, the equalization circuit 36 comprises two filters—one configured to reduce the mid-level frequencies and the other configured to boost the low frequencies in the signal detected at the bridge 18. As stated above, piezoelectric transducers, which are configured as the bridge sensors 19 in this non-limiting example, typically include high energy levels in the middle range of the frequency spectrum. Thus, equalization circuit 36 may be configured to remove, or notch out, these high energy levels. As an alternative, the equalization circuit 36 can be configured to increase the energy levels of the low and high frequency ranges rather than reduce the midrange frequency levels to achieve a similar result.

In this non-limiting example, the circuitry comprising the equalization circuit 36 includes amplifier 70 and associated resistors R9–R12. Additionally, the amplifier 70 is coupled to capacitors C12–14. Similarly, amplifier 71 is coupled to resistors R15–R18 and capacitor C15–C17. It should be obvious to one skilled in the art that the various other circuit configurations may be implemented to achieve similar dynamic equalization results. Nevertheless, the output from equalization circuit 36 is coupled to summing circuit 48.

A third output of the output of amplifier 52 is coupled to level detector 38 via capacitor C18 and resistor R19. Level detector 38 operates in similar fashion as described above regarding level detector 40 in FIG. 3, which controls the gain of gain cell 75. Gain cell 75 is coupled to the output of the equalization circuit 36, which is, more specifically, the output of amplifier 71, via capacitor C19 and resistor R20. The output gain cell 75 is coupled to amplifier 77, resistor R21 and capacitors C20 and C21. Together these components comprise the bridge VCA circuit 42, as described above. Thus in operation, as the level detector 38 senses a greater intensity of signal amplitude output from amplifier 52, the level detector 38 sends an increased control signal to gain cell 75, which therefore increases the gain of the signal received from the equalization circuit 36 that is communicated to amplifier 77.

Limiting circuit 79 is similar to limiting circuit 67, as described above. Limiting circuit 79 comprises attack and release capacitors C22 and C23 as well as diodes D4, D5 and D6. Thus, limiting circuit 79 operates to limit the gain added to or applied by a gain cell 75 such that the signal ultimately output by circuit 31 is limited to a predetermined level with defined attack and release time constants.

The amplifier 77 and related circuitry, which includes resistors R20 and R21 as well as capacitors C20 and C21, perform an expansion function on the signal received from the gain cell 75. As described above, the expansion function expands the dynamic range of the signal received from the bridge sensors 19, which results in a closer modeling of the sound of an acoustic instrument. The output from amplifier 77 is coupled to summing circuit 48 via capacitor C28 and resistor R22.

Summing circuit 48 comprises, in this non-limiting example, amplifier 83 and resistors R6, R23, R24, and R25 as well as capacitor C23. The summing circuit 48 receives as inputs the signal output from the resonance amplifier 61, the equalization circuit 36, and the expansion amplifier 77. It should be noted that both nodes of the summing amplifier 48 are implemented in this non-limiting example; however, all of the inputs may be routed to the inverting input depending on the phasing output from the prior circuitry elements. Thus, one of ordinary skill in the art would know that the input to the summing circuit 83 may be configured in a variety of configurations depending on the phase shifting propagated through the circuit. The output of the summing amplifier 83 is communicated through capacitor C24 and resistor R25 to the output, which is between resistor R26 and ground.

Figure 4:
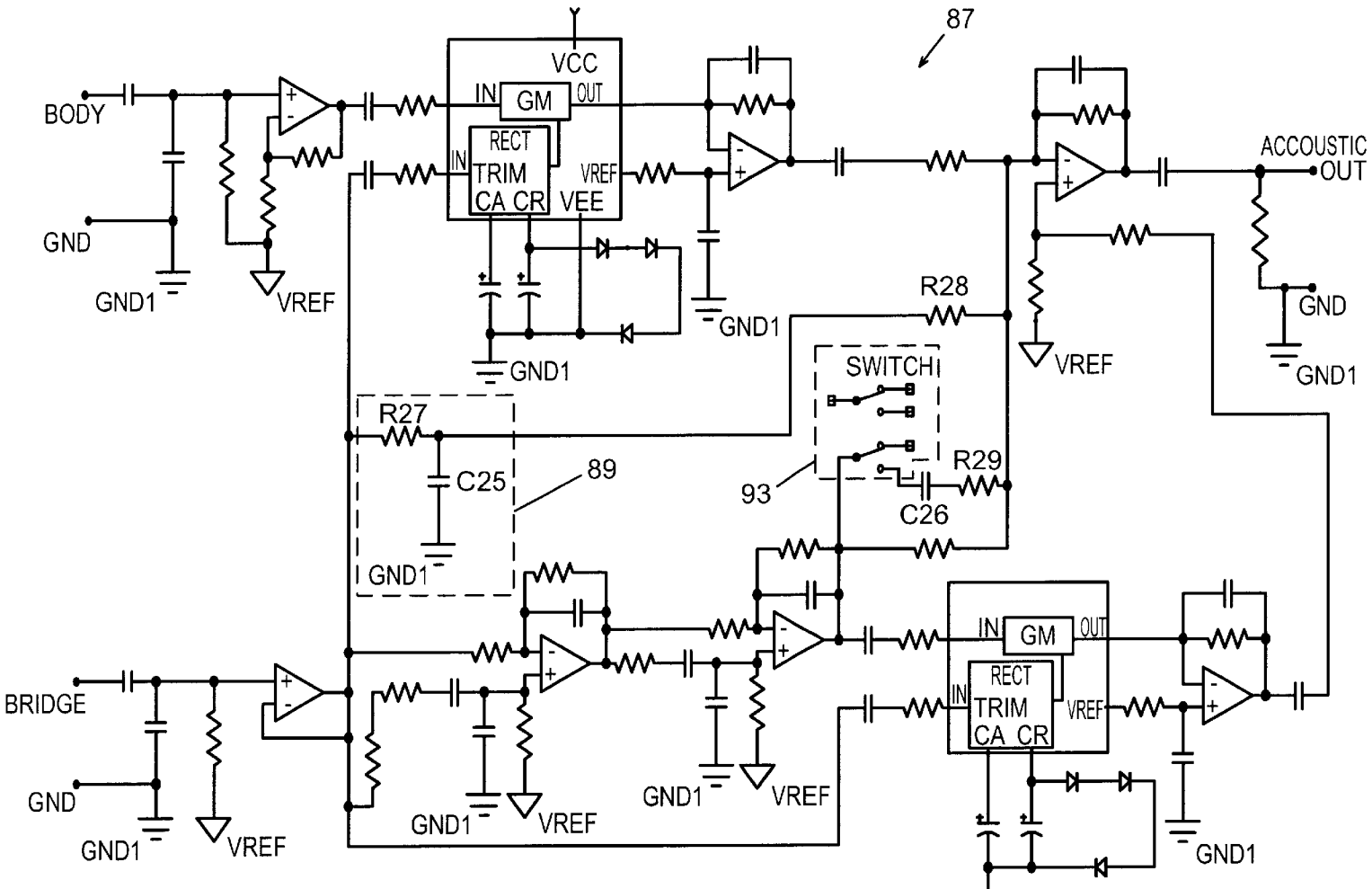
FIG. 4 is a schematic circuit diagram of an alternative embodiment of the acoustic modeling circuit of FIG. 1.

FIG. 4 is a schematic diagram 87 corresponding to an alternative embodiment of the acoustic modeling method and apparatus. In this embodiment, much of the circuitry, as shown and described in and regarding FIG. 3, is included herein. Specific reference is made, however, to a low pass filter 89 coupled between the output of amplifier 52 and the input to summing amplifier 48.

The low pass filter 89 comprises resistor R27 and ground capacitor C25. The low pass filter 89 passes a low frequency portion of the signal received from bridge sensors 19. The path of the low pass filter 89 is in parallel with the equalization circuit 36 and the level detector 38. Low pass filter 89 may be configured so that if a user plays guitar 10 with a low intensity, the bass is emphasized as the low pass filter 89 passes the low frequency components. The output from the low pass filter 89 is coupled through resistor R28 to the summing amplifier 48. One of ordinary skill in the art would know that configuring bridge sensors 19 as piezoelectric transducers (in this non-limiting example) may lead to reduced energy levels for the bass (low) frequencies, thereby leading to the inclusion of the low pass filter 89 if so desired. However, one of ordinary skill in the art would also know that a similar function may be achieved through dynamic equalization circuit 36 by boosting the bass and treble (low and high frequency ranges respectively) while reducing the levels corresponding to the middle frequency range, as described above.

Another alternative embodiment shown in FIG. 4 comprises switch circuit 93. Switch circuit 93 may be configured to provide user selectable tone qualities. In addition, the switch circuit 93 may activate different equalization techniques to boost or notch predetermined frequency ranges. Switch circuit 93 may be controlled by selector 22 (FIG. 1), as described above.

In an additional alternative embodiment, one or more dynamic equalization filters, similar to those shown in circuit 36 and as described herein, may be placed in series with expansion amplifier 77, shown in FIG. 3. For similar reasons as described above, the dynamic equalization filters placed in series with expansion amplifier 77 may boost a selected frequency range, such as a bass (low) or treble (high) frequency range, and/or cut out or notch another frequency range, such as the middle frequency range. The result of this alternative embodiment is that when a predetermined intensity level placed upon the strings 16 of guitar 10 is detected, a boosted signal may result by amplifying the bass and/or treble (low and high frequency ranges), as described herein. Although the equalization circuit is not shown, one of ordinary skill in the art would know and would understand this configuration and placement, especially and based in part on the description of equalization circuit 36.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A method for modeling an acoustic sound in an electric stringed musical instrument having one or more strings, comprising the steps of:

generating a bridge signal corresponding to vibrations of the strings at the bridge of the instrument;

generating a body signal with a body sensor, wherein the body signal corresponds to the resonance of the vibrations of the strings in the body of the instrument;

amplifying the body signal when the amplitude of the bridge signal exceeds a first predetermined level;

amplifying the bridge signal in accordance with the amplified body signal; and adding the amplified body signal with the amplified bridge signal to produce an output signal.

2. The method of claim 1, further comprising the steps of:

equalizing dynamically the bridge signal; and adding the equalized bridge signal with the amplified body signal and amplified bridge signal to produce an output signal.

3. The method of claim 2, wherein the equalized bridge signal is created by reducing energy levels corresponding to a middle frequency range of the bridge signal.

4. The method of claim 2, wherein the equalized bridge signal is generated by increasing energy levels corresponding to the low and high frequency ranges of the bridge signal to correspond to the energy level of the middle frequency range of the bridge signal.

5. The method of claim 2, further comprising the step of:

passing a low frequency range with a low pass filter.

6. The method of claim 1, further comprising the step of:

positioning the body sensor at a point to create a predetermined tonality for the instrument.

7. The method of claim 6, wherein the body sensor is positioned at the junction of the neck and body of the instrument.

8. The method of claim 1, further comprising the step of:

expanding the dynamic range of the amplified bridge signal, wherein the expanded range amplified bridge signal is added to the body signal to produce an output signal.

9. The method of claim 1, further comprising the step of:

limiting the amplification of the body signal to a predetermined amplitude when the amplitude level of the bridge signal exceeds a second predetermined level.

10. The method of claim 1, further comprising the step of:

limiting the amplification of the bridge signal to a predetermined amplitude when the amplitude level of the bridge signal exceeds a second predetermined level.

11. The method of claim 1, wherein the bridge signal is generated by one or more piezoelectric transducers, and further wherein the body sensor includes one or more piezoelectric transducers.

12. An apparatus for modeling an acoustic sound in an electric stringed musical instrument, comprising:

a bridge sensor for sensing string vibrations at the bridge of the instrument, wherein a bridge signal is generated in accordance with the vibrating strings;

a body sensor for sensing the resonance of the string vibrations, wherein a body signal is generated in accordance with the sensed resonance;

a first amplifying circuit configured to amplify the body signal when the amplitude of bridge signal exceeds a first predetermined level;

a second amplifying circuit configured to amplify the bridge signal in relation to the amplified body signal; and a summing circuit configured to sum the amplified body signal with the amplified bridge signal to produce an output signal.

13. The apparatus of claim 12, further comprising:

an equalizer configured to dynamically equalize the bridge signal, wherein the summing circuit adds the equalized bridge signal with the amplified body signal and amplified bridge signal to produce an output signal.

14. The apparatus of claim 13, wherein the equalized bridge signal is created by reducing energy levels corresponding to a middle frequency range of the bridge signal.

15. The apparatus of claim 13, wherein the equalized bridge signal is created by increasing energy levels corresponding to the low and high frequency ranges of the bridge signal to correspond to the energy level of the middle frequency range of the bridge signal.

16. The apparatus of claim 13, further comprising:

a switch for activating one or a plurality of equalizers in the instrument.

17. The apparatus of claim 13, further comprising:

a low pass filter configured to pass a predetermined low frequency range.

18. The apparatus of claim 12, wherein the body sensor is positioned on the surface of the body of the instrument.

19. The apparatus of claim 12, wherein the body sensor is positioned in a cavity located within the body of the instrument.

20. The apparatus of claim 12, wherein the body sensor is positioned on the surface of the body of the instrument and extends into the body of the instrument.

21. The apparatus of claim 12, wherein the body sensor is positioned at the junction of the neck and body of the instrument.

22. The apparatus of claim 12, wherein the body sensor is positioned in the body of the instrument other than the juncture of the neck and body of the instrument.

23. The apparatus of claim 12, further comprising:

an expander configured to expand the dynamic range of the amplified bridge signal, wherein the expanded range amplified bridge signal is added to the body signal to produce an output signal.

24. The apparatus of claim 23, further comprising:

a equalizer configured to dynamically equalize the expanded range amplified bridge signal.

25. The apparatus of claim 12, further comprising:

a control signal limitor configured to limit the amplification of the body signal to a predetermined amplitude when the amplitude level of the bridge signal exceeds a second predetermined level.

26. The apparatus of claim 12, further comprising:

a control signal limitor configured to limit the amplification of the bridge signal to a predetermined amplitude when the amplitude level of the bridge signal exceeds a second predetermined level.

27. The apparatus of claim 12, wherein the bridge sensor includes one or more piezoelectric transducers, and further wherein the body sensor includes one or more piezoelectric transducers.

28. The apparatus of claim 12, wherein the body sensor is comprised of a plurality of sensors.

29. The apparatus of claim 12, wherein the body sensor is comprised of a plurality of sensors positioned throughout a body portion of the instrument.

30. A system for modeling an acoustic sound in an electric musical instrument having one or more strings, comprising:

means for sensing string vibrations at the bridge of the instrument, wherein a bridge signal is generated in accordance with the vibrating strings;

means for sensing the resonance of the string vibrations, wherein a body signal is generated in accordance with the sensed resonance;

means for amplifying the body signal when the amplitude of bridge signal exceeds a first predetermined level;

means for amplifying the bridge signal in relation to the amplification of the body signal; and means for combining the amplified body signal with the amplified bridge signal to produce an output signal.

31. The system of claim 30, further comprising:

means for equalizing the bridge signal, wherein the means for combining adds the equalized bridge signal with the amplified body signal and amplified bridge signal to produce an output signal.

32. The system of claim 30, further comprising:

means for expanding the dynamic range of the amplified bridge signal, wherein the means for combining adds the expanded range amplified bridge signal to the body signal to produce an output signal.

* * * * *